United States Patent [19]

Rudner

[11] 4,265,972

[45] May 5, 1981

[54] COATED FIBERS AND RELATED PROCESS

[76] Inventor: Bernard Rudner, 25 Kenwood Rd., Ridgewood, N.J. 07450

[21] Appl. No.: 19,164

[22] Filed: Mar. 9, 1979

[51] Int. Cl.[3] ..... D02G 3/00

[52] U.S. Cl. ..... 428/392; 264/45.5; 264/45.9; 428/373; 428/375; 428/394; 428/395; 428/398; 428/401

[58] Field of Search ..... 428/375, 376, 373, 374, 428/398, 394, 392, 395, 401; 264/41, 45.5, 45.9, DIG. 14; 65/3 C

[56] References Cited

U.S. PATENT DOCUMENTS

| | | | |
|---|---|---|---|
| 2,862,284 | 12/1958 | Wiczen | 428/376 |
| 3,244,545 | 4/1966 | Marzocchi et al. | 65/3 C |
| 3,278,329 | 10/1966 | Wiczen | 427/373 |
| 3,287,892 | 11/1966 | Rapoza | 57/225 |
| 3,424,645 | 1/1969 | Ohsol | 428/398 X |
| 3,462,523 | 8/1969 | Marzocchi et al. | 427/340 X |
| 3,474,049 | 10/1969 | Chappelear et al. | 521/81 |
| 3,474,050 | 10/1969 | Chappelear et al. | 521/59 |
| 3,474,051 | 10/1969 | Chappelear et al. | 521/59 |
| 3,480,569 | 11/1969 | Chappelear et al. | 521/81 |
| 3,507,741 | 4/1970 | Aleixo | 428/394 |
| 3,676,094 | 7/1972 | Russell | 65/3 C |
| 3,761,346 | 9/1973 | Caroselli et al. | 428/152 |
| 3,785,919 | 1/1974 | Hickman | 428/398 X |
| 3,889,038 | 6/1975 | Wiczer | 428/361 |
| 4,010,308 | 3/1977 | Wiczer | 428/372 |

*Primary Examiner*—Lorraine T. Kendell
*Attorney, Agent, or Firm*—Daniel J. Reardon

[57] ABSTRACT

A composite fiber or filament comprising a core or substrate coated with a cellular foam, and an outer circumference characterized by a substantially continuous, microcellular breathable and abrasion-resistant aspect.

39 Claims, 2 Drawing Figures

COATED FIBERS AND RELATED PROCESS

BACKGROUND OF THE INVENTION

This invention relates to a composite fiber formed of a sheath and core, adapted particularly for knitting, weaving or floccing wherein the core is a fiber or monofilament and the sheath enveloping the core is a cellular and pervious foam contiguous with, and adjacent, the core, and a microcellular less pervious foam at, and adjacent to, the outer perimeter of said sheath, the surface of which is regular and continuous in appearance. The invention relates, as well, to a method for producing these composite or conjugate fibers.

Combinations of foam and fiber have been known heretofore. The production more particularly of flexible cellular foam fibers having an outer envelope of woolen yarn or a combination of wool and synthetic fibers has been described heretofore, illustratively, in U.S. Pat. No. 3,287,892. The resulting product does not however present an outer surface of skin resistant to abrasion and inherently resistant to attack by moths or the like. The product also attains normally a reduced bulk without an economic use of materials; an incident of the use of the woolen fiber to define the outer surface rather than the core.

It has also been known to provide a cellular structure in which are disposed a plurality of glass fibrils, that involves coating glass fibrils with a thermoplastic polyurethane solution, immersing the coated product in a higher-boiling, miscible, non-solvent for the thermoplastic resin and heating this composition to drive off the initial solvent in which the resin is dissolved; forming the precipitated thermoplastic polyurethane and disrupting the invested glass fibrils. The product, as will be evident, cannot be woven, spun or knit; and presents a weakened product in solvent-susceptible state that cannot be dry cleaned by any conventional treatment means and has an abrasion-resistance that would render it vulnerable to excessive wear even when subject to washing.

Modifying a fiber to yield a porous irregular surface thereon is known and described in U.S. Pat. Nos. 2,862,284; 3,278,329; 3,889,038; and 4,010,308. The use of these fibers in standard spinning and weaving procedures is, however, severely inhibited or prevented by the induced irregularity of the fibers' surface; and their use in apparel, for example, limited by their lack of abrasion resistance.

The production of a foam mass incorporating a reticulum of polyamide, polyester or polyolefin fibers and forming a sheet or mat is also well known heretofore. Mats or sheets, such as the foregoing are described in U.S. Pat. Nos. 3,474,049; 3,474,050; 3,474,051; and 3,480,569 and utilize ratios of foaming components to fiber such that the volume of foam effectively exceeds that generally conceded to be desirable in formulating a discrete foam-covered fiber.

The length to diameter ratio of the individual fibers forming the network of the patentees' mats is also recited as not exceeding 10,000 to assure a continued adhesion between the fibers and surrounding foam. This length is however inadequate for the purpose of providing fibers for spinning, weaving or the like. The surface of the mats produced by the patentees will also be porous and irregular.

Accordingly, if a composite fiber or filament could be produced, and a process evolved for its preparation, having a continuous core fiber and adhering thereto an inner cellular thermoset sheath composed of a low density ply terminating at its outer perimeter in a high density ply having a smooth regular and continuous outer "skin" of limited porosity with accompanying superior abrasion- and tear-resistance properties, the result would be a significant advance in the state of the art.

If, additionally, the composite fiber and filaments so formed were capable of modifying or masking the undesired properties of the core fiber while providing significant integration of the inner and outer sheath with one another and with said core fiber, for example, and providing in contrast with the core fiber alone, improved bulking, pleasant and warm hand, ready dyeability, decreased crushability, increased resiliency, less hygroscopicity and better wet properties and yet fibers that are readily woven, spun or flocced the advance manifested in the art would be significant indeed.

SUMMARY OF THE INVENTION

It is, accordingly, an object of this invention to provide an improved composite fiber composed of a core fiber and a resilient cellular sheath.

It is a further object of this invention to provide an improved method for production of the foregoing core fiber.

It is a still further object of this invention to provide a composite filament or fiber composed of a core fiber and a sheath the outer ply or zone of which manifests a high density, microcellular construction and a smooth regular outer surface; and the inner ply or zone of which is characterized by a macrocellular structure and reduced density.

It is an additional object of this invention to provide a composite fiber having improved abrasion and tear resistance; that provides improved bulking, a warm, desirable hand, a ready dyeability even where the core fiber is, for example, a glass, asbestos or polyolefin, less hygroscopicity and better wet properties than natural fibers although a natural fiber may provide the core, and an integration of fiber properties generally, including, illustratively, an enhanced resilience and decreased crushability.

It is a particular object of this invention therefore to provide a composite fiber having increased utility and flexibility in use and that can be spun, woven, flocced and the like.

Other objects and advantages of the invention will become evident from the following description.

Accordingly, a composite fiber has now been discovered, and this constitutes, in a general manner, the invention, that incorporates the unique and improved properties recited as objects hereinabove and is composed of a flexible synthetic or natural organic or inorganic core fiber, wherein the fiber is a monofilament or a multifilament yarn, enveloped by a sheath composed of an inner and outer ply or zone and wherein the outer portion or ply has a relatively high density and the inner portion or ply a low density, both portions formed in one embodiment of different foamed thermoset resins or successive piles of the same resin, or in a significantly preferred embodiment, of the same foam polymer deposited in a single application, the outer ply, in any event, being microcellular and having a relatively high density and the inner ply or portion of the sheath having a macrocellular construction and a relatively reduced density.

The term "thermoset" as employed herein with respect to thermoset resins for use herein is intended to encompass both resins that are in the thermoset state in that the resins are irreversibly thermally cross-linked; and thermosettable resin, that is, those resins capable of conversion to the thermoset state, that is a state in which they are irreversibly cross-linked. In the practice of the present invention, only the outer ply or "skin" attains an actual thermoset state, whereas the inner ply, if formed of a thermoset resin, remains thermosettable and resilient is the final product.

The process of the invention comprises, generally, applying to an advancing core fiber, having a length to diameter ratio of at least 20,000, a foamable thermoset polymer, foaming the polymer to provide a cellular sheath; and before curing is completed, compressing the heated outer perimeter of said sheath to induce both skin formation, some loss in height, and the properties described hereinabove and in greater detail hereinafter. In an alternative but normally and significantly less desirable practice of the invention, an initial application of foamable resin is deposited and cured followed by a second deposit of the same or another foamable resin, which, after foaming and before curing is completed, is subjected to compression to secure the desired skin formation.

DETAILED DESCRIPTION OF THE INVENTION

Figure 1:
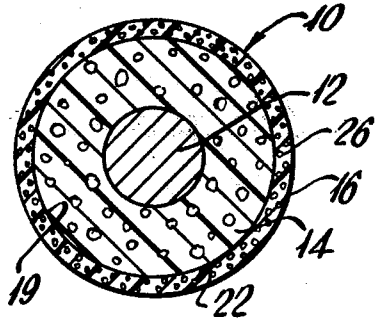
FIG. 1 is a view in cross-section of a composite fiber of the present invention.

Referring now in detail to the accompanying drawing, there is shown in FIG. 1 the composite fiber 10 of the invention incorporating a core fiber 12 and the inner and outer plies or portions 14 and 16 respectively of the sheath 19.

The core fiber may be disposed concentrically as shown in FIG. 1 and it is most often convenient and desirable to do so. It may also be disposed eccentrically within the sheath. The core fiber may also be elliptical in cross-section and the surrounding foam, circular in the same cross-section of composite fiber, or vice versa; and indeed, both core fiber and surrounding foam may be elliptical. The term "fiber" as employed in connection with the composite fiber's core is intended, as indicated hereinabove to embrace both monofilaments and multifilament yarns, and if the latter, the filaments may be coentwined or be disposed in contiguous parallel alignment.

The core fibers include extensible and inextensible, natural and synthetic, inorganic and organic thermoset and thermoplastic flexible fibers such, illustratively, as glass (e.g. E-glass fiber), polyesters, polyolefins, polycarbonates, and polyamides.

Illustrative of the natural and synthetic polyamides are wool, silk, Nylon 6, Nylon 66, Nylon 12, Nylon 6,12, and mixed and copolymerized derivatives thereof as well as peanut, milk, and algin protein polymers.

The polyamides, thus, include the commercially available polymers of hexamethylenediamine and adipic acid; epsilon-caprolactam, hexamethylene diamine and sebacic acid; polymerized vegetable oil acids and polyalkylene polyamides; 11-aminoundecanoic acid and hexamethylene diamine; lauryl lactam and adipic acid and sebacid acid; and hexamethylenediamine and adipic acid and sebacic acid modified with pentamethylene diamine and decamethylene diamine. Other illustrative constituents for inclusion with the foregoing polyamides in the formation of mixed or copolymerized polyamides are succinic acid, p-phenylene diacetic acid, ethylene diamine, teremethylene diamine and decamethylene diamine. Polyamides particularly useful in the formulation of fibers for employment in the present invention are further characterized in Kirk-Othmer, *Encyclopedia of Chemical Technology,* Vol. 10, Interscience Encyclopedia, Inc., New York, N.Y., pages 918–921 (1953).

The polyesters useful in the practice of the invention include, for example, polyethylene terephthalate, and copolymers thereof including standard dioxy and dicarboxylic acid components well known to those skilled in the art to which this invention pertains.

The polyesters useful herein include those derived from dicarboxylic acids and anhydrides such as isophthalic acid, oxy-bis-benzoic acid, phthalic acid, phthalic anhydride and diols such as propylene diol, diethylene glycol, 1,4-cyclohexane dimethanol and butanediol.

Illustrative of the polycarbonates that may be utilized in the practice of the invention are those made by reaction of $Ar(OH)_2$ formate, $$Ar(O\overset{\overset{\displaystyle O}{\|}}{C}Cl)_2;$$

or a simple carbonate, the preparation of which is illustrated by the following reaction sequence:

$$Ar(OH)_2 + ROC\overset{\overset{\displaystyle O}{\|}}{O}R \longrightarrow 2ROH + \left(OArO\overset{\overset{\displaystyle O}{\|}}{C}OArO\overset{\overset{\displaystyle O}{\|}}{C}\right)_x$$

More particularly, examples of polycarbonates suitable for use herein include the equimolar reaction products of 4,4'-dihydroxyphenyl ether/bisphenol A; 4,4'-dihydroxyphenyl ether/4,4'-dihydroxyphenyl ketone; the 3:1 molar reaction product of 4,4'-dihydroxy phenyl ether/hydroquinone and the $\frac{1}{3}$ molar reaction product of 4,4'-dihydroxytriphenyl ether/bisphenol A; aromatic-aliphatic polycarbonates such as the equimolar reaction products of bisphenol A with coreactants such as ethylene glycol, hydrogenated bisphenol A, p-xylyene glycol and 1,6-hexane diol; and polyester-polycarbonates prepared from acids such as adipic acid, terephthalic acid; p-hydroxy benzoic acid and the like.

Additional fibers adapted for use herein include those made, as indicated, from synthetic and natural celluloses including jute, ramie, flax, cotton, viscose, rayon, hydroxyethylcellulose, and cellulose esters such as cellulose acetate; polyolefins such as polypropylene and polyethylene; acrylics such as ORLON and ACRILAN polyacrylonitriles; polyhalaloalkanes such as TEFLON fiber, VINYON poly (vinyl chloride) and poly (vinylidene chloride).

The sheath 19, as to both its inner and outer plies 14 and 16 respectively, is an open, or partially open, flexible and resilient and extensible foam. The elastomer foams, including the rubbers, SBR, EPDM, natural rubber, latex and RTV silicon rubber foams and the denser vinyl resin foams as described in U.S. Pat. No. 3,717,595, are all useful in the practice of the invention, but significantly preferred, and indeed, useful exclusively in a preferred mode of preparation of the composite fibers of the invention, are flexible polyurethane thermoset foams, either ether-polyol based or ester-polyol based. Polyurethanes are preferred generally because they provide the best combinations of bulk, dyeability, physical properties, hand and low density. Again, polyurethane foam is readily obtainable in a greater range of permeabilities than other available foams, thus serving convenience and greater comfort within the broader range available when utilized in textiles. Most significantly, and critical to particular embodiments of both the method and product coming within the practice herein defined, is that the flexible polyurethane foams for use herein are the most significantly effective cellular foams that can be modified in-line according to the process of the invention to provide a regularly surfaced thin, abrasion and tear-resistant coating, skin or ply, free of obvious pits and holes and having an enhanced density and microcellular structure.

The cellular elastomer and vinyl resin foams for use herein, in addition to the polyurethanes, are capable of being coated by an additional foam layer or ply but even where the outer ply or coat is provided in a separate, additional application, in accordance with one embodiment of the invention as described in detail hereinafter, a polyurethane is preferred in forming both the inner and outer plies or zones of the sheath 19. The line of demarcation 22 between the inner ply 14 and outer ply 16 shown for purpose of illustration in FIG. 1 is not regular in the manner depicted where a separate outer coat is employed because of the irregular surface presented by the inner ply of foam. Where the inner ply is formed without addition of a separate ply the line of demarcation is actually a transition zone which may be defined as that point where the cellular foam of the inner ply assumes a microcellular structure and desirably where polyurethanes are employed, a density in excess of 30 pounds per cubic foot (pcf), and preferably 50 pcf.

Thus, the outer ply 16 is a circumferential microcellular zone having a density, normally where polyurethanes are employed, in excess of 30 pcf and preferably within the range of 50 to 70 pcf and, indeed, a density of up to 80 pcf is within the contemplation of the present invention. The density of this outer ply is uniform or essentially uniform across the thickness of the ply 16 where the ply is about 5 mils or less in thickness. Where thicker, its inner most density will be less than that near the outer surface. The inner zone 14 has an average density that attenuates downwardly as it approaches the core fiber 12, particularly where the outer and inner zones are derived from a single deposit of foam. Normally, the density of the inner ply or zone 14, does not exceed, 1.5 pcf immediately about the core fiber 12, and approaches about 20 pcf, and up to 30 pcf, immediately adjacent the outer ply 16. Indeed, a density may be attained at this outer circumference of the inner ply 14 approaching but less than the density of the outer ply 16.

The upper limit of density of the outer ply is consistent normally with continued gas permeability therethrough.

The thickness of the inner zone 14 at any point about the core fiber 12 is from 10 percent (%) to 500 percent of the cross-sectional area of the composite fiber product; and will be varied with the particular end use of the product contemplated.

The thickness of the inner ply 14 is from 10 percent to 500 percent and preferably from 50 percent to 400 percent, that of the radius of the core fiber 12. The thickness of the outer ply or skin 16 is about 0.01 percent to 100 percent that of the core fiber 12. A preferred thickness is from about 0.05 percent to 2 percent and most desirably about 1 percent. A length of composite fiber prepared in accordance with the invention will in one embodiment, have a distrubution of weight such that the aggregate weight of the plies 14 and 16 is more than half that of the core fiber 12, where the core fiber has low density, for example, where formed from polypropylene and the foam of the surrounding plies if formed from a high density material such as chloroprene foam having a density before compression of about 22 pcf.

Expressed in terms of weight or mass the cellular sheath varies within the range of 1 percent to 50 percent of the core fiber.

Most desirably, in order to secure the maximum advantage of core fiber and foam sheath for use in textile applications, the sheath should not exceed at the upper limit a thickness of three times that of the core fiber cross-sectional area. At the same time, the outer zone or ply, providing a smooth, gas permeable, but substantially uninterrupted surface 26 to the composite fiber is thin relative to the inner zone or ply 14, and has a thickness at any point in its circumference within the range of 10 percent to 15 percent that of the cross-sectional area of the total sheath or ply for a desirable range in diameter thickness of 0.5 mil to 15 mils and preferably 0.5 mils to 5 mils. The corresponding thickness of the sheath is 5 mils to $\frac{1}{4}$ inch, and that of the core fiber 0.5 mil to $\frac{1}{4}$ inch, respectively. The composite fibers contemplated by the invention do not normally exceed 2 inches in thickness.

Figure 2:
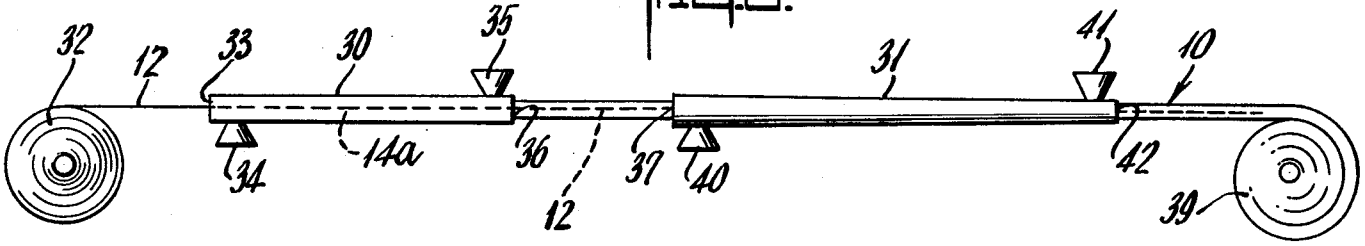
FIG. 2 is a semi-diagrammatic view of the process and apparatus employed according to the invention in producing the product of FIG. 1.

As shown diagrammatically in FIG. 2, the composite fibers of the invention are formed by preparing a preparative train of two successive horizontally disposed inflexible tubes 30 and 31, unaffected by high temperatures, and made, illustratively, of steel having a smooth seamless core formed desirably of an internal coating of poly (tetrafluoroethylene), marketed by E. I. DuPont de Nemours Co., Wilmington, Del., under the trade name TEFLON, through both of which the core fiber 10 is threaded in such a manner, most desirably, as to be centrally disposed and so retained in the course of its passage and treatment. The tube can be formed entirely of TEFLON as well.

A successive train of two tubes is preferred in that they permit venting, ready inspection and intermediate modification or treatment of the fiber prior to curing and compression of the outer ply 16. A single tube can be employed, however, if desired. The tube or tubes can, of course, be disposed vertically or at an incline in generally less preferred embodiments.

The core fiber 10, as shown in FIG. 2 is delivered from a reel 32 but the fiber 10 may also be delivered directly from a spinnerette or extruder immediately after the formation of the core fiber itself. The two tubes are of about the same length, or most desirably, the second tube is longer than the first, e.g. 6 inches to 30 inches for the first tube and 6 inches to 360 inches for the second tube. The tubes are separated by a distance of 5 to 15 feet, illustratively, depending on the kind and quantity of foamable resin used, foaming agent, and curing temperatures employed and the like. The distance of ambient cooling air between the tubes 30 and 31 is, by way of illustration, where a polyester urethane is employed, generally material less than that utilized where a polyether urethane is to be applied to the core fiber. The cross-sectional diameter of the second tube 31, is, most desirably, less than that of the first tube 30 although the cross-sectional diameter of the lumen of the second tube 31 at the core fiber entry port 37 is the same as that of the first tube 30 or sufficiently so as to receive the sheathed fiber emanating therefrom to effect the objectives of the invention. This reduced diameter is required in the second tube 31 because the interior of the second tube is used to form the skin or outer ply 16 by compression as well as to cure the compressed foam of this outer ply.

Downstream of, but adjacent to, the core fiber entry orifice 33 of the first tube 30 is disposed on the underside of the tube 30 a foam entry port 34 through which foamable resin is fed into the tube 30 and about the core fiber 12. The resin 14*a* adheres to the advancing core fiber 12 immediately upon contact therewith and is pulled away from the foam source by the filament or fiber 12 on which it foams. The foamable resin is mixed vigorously immediately adjacent the foam entry port 34. The foamable resin is produced using, for example, where polyurethanes are employed, the conventional "prepolymer process", "one shot process" or known variations thereof, such as the semi-prepolymer process.

The relative positions of the core fiber entry orifice 33 and foam entry port 34 are preferably such as to provide maximum and most immediate contact between the core fiber 12 and the foam of the sheath 19. The foam entry port 34 may be placed upstream of the core fiber entry port 33 but it is easier mechanically to center or otherwise locate the core fiber 12 for passage through the tube or tubes 30 and 31 when it is introduced in the manner of FIG. 2 before the foam and in an identical plane with that in which the tubes 30 and 31 are disposed.

It will be evident that since the foam-forming mixture is pressured into the tube 30, it is substantially immaterial whether the point of entry of the foam is above or below the plane of fiber travel in the tube 30. The tube 30 may indeed have a plurality of foam entry ports. It is important, however, that the foam mixture be well mixed prior to entry into the tube 30, since the tube provides no opportunity for adequate mixing.

The coated fiber continues its progress through the tube, as the polyurethane foam, in this preferred embodiment creams, rises and cures enough to be self-supporting. The amount of foam fed into the tube is sufficient to expand and impinge on the smooth inner wall of the tube. Any excess is removed through the foam recovery port 35 provided near the downstream core fiber entry port or orifice 41.

The foam ingredients are admixed at 20° C. to 90° C. and are injected into the first tube 30 under the positive pressure normally applied in transferring these foamable admixtures to a reaction site. The foam-forming reaction, that is the creaming, initial rising and partial curing, which takes place in the first tube 30 is exothermic and because of gas formation produced in the limited mold provided by the tube (30) enclosure creates increased pressure. Upon leaving the exit port 36 and where an intervening space open to the ambient atmosphere is provided before entry of the sheathed core fiber into the second tube 31, atmospheric, or other ambient, pressure will apply. This is, however, succeeded by heating to temperatures from above ambient and most desirably about 100° C. to 150° C., a particularly preferred operating temperature being about 140° C. in the second tube 31. The foam rises between 50% to 95% of its free rise height as the core fiber to which it adheres passes through the first tube 30 and into and through the hiatus between the tube 30 and the flared, or preferably, gradually tapered fiber entry port 37 of the second tube 31. The core fiber and foam are then forced through the second tube where the foam is irreversibly compressed at the elevated temperature recited hereinabove which causes the foam to attain its ultimate free rise height and impinge upon the inner tube wall while foam curing is completed and the fiber advances through the tube 31. In this manner the smooth regular gas permeable or breathable, microporous skin or surface is formed constituting the outer surface or compressed zone or ply 16 of the sheath 19.

The diameter of the second tube 31 is approximately the same at its entry port 37 as that of the first tube 30 but is thereafter tapered inwardly either rapidly, giving the entry port 37 a flared appearance or gradually and uniformly, in a preferred mode, toward the exit port 42. Of course a combination of rapid and gradual contraction of the cross-sectional tube diameter is also feasible. The contraction from entry port 37 to exit port is, in any event, within a preferred range of from 5 percent to 20 percent. The lumen of the tube 31 as characterized by the diameter of the tube adjacent to and at the exit port 42 will define the ultimate diameter of the composite fiber of the invention. The cured composite fiber is recovered from the tube on conventional reels or spools 39. The fiber advances through the treatment tubes 30 and 31 and intervening space at a rate of about 0.5 to 1.5 feet per minute; and preferably about 1 foot per minute. If only a single tube is employed the second half of the tube will have the characteristics of the second tube 31 described hereinabove.

The rate of feed of core fiber through the treatment tube or tube 30 and 31 is such, in any event, that the core fiber 12 is removed fron contact at all times from the surrounding inner surface of the tubes. As seen in FIG. 2 the feed roll 32 and take-up roll 39 can be suitably tensioned to assure this result. Other means whereby a like result is secured in passage of the core fiber 12 through the tubular molds 30 and 31 are well known to those skilled in the relevant art to which this invention pertains.

In a significantly less preferred embodiment, foamable resin is introduced into the process in two steps rather than one; the first being at the foam entry port 34 of the first tube, and the second at the bottom foam resin entry port 40 downstream of, but adjacent to the fiber entry port 37 of the second tube 31. In this embodiment, the cross-sectional diameter of the heated second tube is greater than that of the first tube. Consistent with what has been stated hereinabove the increase or decrease in diameter between the two tubes does not normally exceed 5 percent to 20 percent, e.g. $\frac{1}{4}$ inch, and preferably $\frac{1}{8}$ inch. The foamable resins introduced may be the same or different from one another where two deposits are introduced. A second foam recovery port 41 is positioned near the downstream composite fiber exit port 42 of the second or compression tube to provide a means for emitting excess foam from the tube 31. The second foam deposit will fill the void existing within the heated release-lined tube and about the cured inner zone or ply 14 produced, for example, from polyurethane, and adhere thereto. This second application of resin is permitted to cream rise and cure to completion and is metered into the void at such a rate and in such a volume that is is compressed to a microcellular structure and a concomitant high density between the completed inner ply 14 to which the second resin adheres securely and the boundary formed by the inner TEFLON wall of the tube as it advances toward the reel or spool 39 upon which the resulting composite fiber will be wound when curing is completed. The over-all length of the tubular mold or tube and treatment time in this latter double-coating procedure are generally longer than those described with respect to the first and preferred embodiment. While adherence of the separate plies in this latter embodiment is satisfactory the procedure described in relation to FIG. 2 is preferred as it reduces significantly the likelihood of delamination even in the harshest circumstances.

The foams employed in the practice of the invention can be generated as part of the polymerization process, using, for example, conventional processing techniques employed in manufacturing flexible or semi-flexible polyurethanes. Alternatively the foam can be generated after the polymer mass is formed during the course of, or after extrusion, onto the core fiber, as illustratively in the conversion of a plastisol of polyl (vinyl chloride) or one of its copolymers into its corresponding foam about the core fiber.

Where a vinyl polymer is employed in place of a polyurethane, the heat release lined tube 31 must be longer and heated at different graded temperatures along its length to first generate foam from the azo component, e.g. azobisdicarbonamide, and vinyl resin plastisol after it gels, following which compression is effected and the smooth regular outer skin or surface 26 of the composite fiber 10 produced.

A factor critical to the formation of the composite fibers of the invention is that the ratio of length to diameter (L/D ratio) of the core fiber 12 be at least 20,000; illustratively, at least 10 inches long usually. Certain of the core fibers recited for use herein have L/D ratios of less than 20,000; for example, cotton and natural cellulosic fibers. These fibers can be employed, however, where they are twisted or otherwise processed into lengths greater, e.g. in excess of 10 inches by twisting or processing by means well known in the textile art.

The finished composite fibers 10 need not retain the foregoing L/D ratio, this limitation having application only to the process of preparation and manufacture of the finished composite fiber.

Where yarn is to be coated according to the invention, it must first be formed before coating is effected. Where several twisted core fibers or filaments are twisted to form a yarn, then given a single foam-coating, the resulting bulked fiber will have a higher modululus than one in which the individual core fibers are foam-coated before the yarn is made.

The polyurethanes used in the practice of the invention are, as indicated, most desirably, flexible, open-cell, polyether urethanes and polyester urethane foams in which the resins are, illustratively, those prepared by the conventional prepolymer, semi- or quasi-prepolymer, and one-shot processes. The flexible polyurethane foams of the invention are prepared using techniques well-recognized in the art [see, for example, Saunders et al. Polyurethanes: *Chemistry and Technology*, Part II, pages 1–191, Interscience Publishers, New York, (1964)]. However, criticality resides in the particular combination of reactants employed in accordance with the invention. The term "flexible polyurethane foam" as used herein has the meaning normally attributed to this term: see Saunders et al. ibid, page 117. Thus, said term is used to describe a class of polyurethane foams characterized by a high ratio (i.e. greater than unity and generally from about 15:1 to 70:1) of tensile strength (at 25 percent deflection) as determined by ASTM D 1564-62T, high elongation, high rate of recovery from distortion (rebound) and high elastic limit. These characteristics distinguish a "flexible" from a "rigid" polyurethane foam, the latter being characterized by a combination of a high ratio of compressive to tensile strength, low elongation, low rate of recovery from distortion and a low elastic limit.

Within the broad classification of flexible foams as defined above is a group of foams commonly referred to as "semi-flexible". Semi-flexible foams possess the distinguishing properties described above for the generic class of flexible foams and, in addition, are characterized by a high order of compressive strength at 25 percent deflection remaining greater than unity, a density of the order of about 1.0 to about 30.0 lbs. per cubic foot and a lower rate of resilience. Thermosetting polyurethane resins are materially preferred in the practice herein described although thermoplastic polyurethanes are operative.

The polyisocyanates which are employed in preparing the polyurethane foams of the invention include, illustratively, mixtures of polyisocyanates containing 100 percent toluene diisocyanate or (1) from 5 percent to 95 percent by weight of toluene diisocyanate ("TDI") and (2) from 95 percent to 5 percent by weight of polymethylene polyphenyl polyisocyanates ("MDI" polymers) containing from about 40 percent to about 70 percent by weight of methylenebis phenyl isocyanate ("MDI"). The toluene diisocyanate employed in the above mixtures can be present as 2,4-isomer or the 2,6-isomer or mixtures thereof, the latter isomer is, indeed, usually available only as a mixture such as the mixtures containing 80 percent by weight of the 2,4-isomer and 20 percent of the 2,6-isomer and those containing 65 percent by weight of the former and 35 percent of the latter, both of which are commonly available commercially.

The polymethylene polyphenyl isocyanates set forth above are well-known in the art and can be prepared in accordance with conventional techniques by phosgeneration of the corresponding mixtures of methylene bridged polyphenyl polyamines. The latter are obtained by condensation of aniline and formaldehyde in the presence of aqueous mineral acid, usually hydrochloric acid, by procedures known in the art: see, for example, Canadian Pat. No. 700,026; U.S. Pat. Nos. 2,950,263 and 3,012,008; and German specification No. 1,131,877. As is well known in the art, the desired proportion of methylene-(phenyl isocyanate) in the polymethylene polyphenyl isocyanate is attained by controlling the proportion of methylene dianilines in the intermediate polyamine, and the latter proportion is, in turn, controlled by adjusting the ratio of aniline to formaldehyde in the initial condensation of these components.

The TDI employed is either distilled or crude or mixtures of either with MDI or MDI polymers. Crude TDI includes, not only TDI, but cylic dimers and cylic trimers of TDI. The dimer is principally 1,3-bis-(3'-isocyanato-4'-methylphenyl)azetidinedione. The trimer, or so-called "isocyanurate", present is 1,3,5-tris-(3'-isocyanato-4'-tolyl)triketotrihydrotriazine. The MDI or MDI polymers can be replaced, as well, by aliphatic diisocyanates (e.g. the hexamethylene diisocyanate of E. I. duPont de Nemours Co., Wilmington, Del.); or duPont's hydrogenated MDI; cycloaliphatic diisocyanates (e.g. Veba's isophorone diisocyanate), or aralkyl diisocyanates such as m- or p- xylylene diisocyanate.

The polyols which are employed in making the flexible foams of the invention include polyether polyols having an equivalent weight of about 500 to about 2500 and a functionality of about 2 to about 4. Preferably, the polyether polyols employed in preparing the flexible foams of the invention are triols having an equivalent weight of about 900 to about 2300. Particularly preferred for use in preparing the polyurethanes for use herein are those polyols having a hydroxyl number, as this latter term is hereinafter defined, within the range of from about 32 to 150. As is well known in the art, the hydroxyl number is defined as the number of milligrams of potassium hydroxyl required for the complete neutralization of the hydrolysis product of the fully acetylated derivative prepared from 1 gram of polyol. The hydroxyl number can also be defined by the equation:

$$OH=(56.1\times 1000\times f/m.w.)$$

where

OH = hydroxyl number of the polyol f = average functionality, that is, average number of hydroxyl groups per molecule of polyol m.w. = average molecular weight of the polyol.

The polyether polyols can be a mixture of two or more polyols as well as one polyol. The polyethers employed as the active hydrogen-containing reactant are therefore those derived from the condensation of one or more mols of an alkyleneoxide with a low molecular weight polyhydric alcohol, or mixtures thereof, wherein the alcohol or alcohols present in their entirety or in a major proportion by weight are triols. The conventional alkylene oxides used are, for example, ethylene oxide, propylene oxide, butylene oxide, styrene oxide, amylene oxide and the like and mixtures thereof.

Polyethers for use herein also include, by way of further illustration, the commercially available high molecular weight poly(oxypropylene) derivatives of polyhydric alcohols, such as poly(oxypropylene) ethers of glycerol, trimethylolpropane, 1,2,6-hexametriol and sorbitol. Among these polyols are the primary end-capped (ethylene oxide) triols having a molecular weight of about 3000 to 7000 and particularly about 4500.

Other polyols employed in preparing the polyethers of the invention are 1,4-butanediol, 1,3-butanediol, dodec-9,10-ene-1, 2-diol, thioglycol, 1,6-hexane-diol, thiodiglycol, 2,2-dimethyl propane-1,3-diol, 1,18 octadecane diol, 2-ethyl hexane-1,3-diol, 2,4-dimethyl-2-propyl heptane-1,3-diol, 2-butene-1,4-diol, 2-butyne-1,4-diol, diethylene glycol, triehylene glycol, dipropylene glycol, pentaerythritol, hexahydropyrocatechol, 4,4'-dihydroxydicyclohexyl dimethylmethane and the like and mixtures thereof.

The alkylene oxide normally contains from 2 to 5 carbon atoms, in any event, and is condensed, advantageously, with from about 5 to about 30 mols per functional group of the polyol initiator. Illustrative processes for preparation of polyhydric polyalkylene ethers for use herein include those described in U.S. Pat. No. 3,009,939, U.S. Pat. No. 3,061,625 or that disclosed in the *Encyclopedia of Chemical Technology*, Vol. 7, pages 257, 262, Interscience Publishers (1951).

Other suitable high molecular weight polyols are so-called polymer/polyols including styrene-acrylonitrile-polypropylene oxide copolymers sold by Union Carbide Corporation, 270 Park Ave., New York, N.Y., under the trade name designations NIAX Polyol 32-33, NIAX Polyol 31-28.

Preferred ester-based polyols for use in the manufacture of polyurethane for use herein are those, well-known to those skilled in the art, made by reacting a dicarboxylic acid, such as adipic acid, with a simple diol, (usually diethylene glycol) in the presence of enough triol, (e.g. glycerine, trimethylolpropane or the like) to provide an average of 2.1 to 2.5 hydroxy moieties per molecule of ester-based polyols.

Other suitable polyols for use in the manufacture of the flame retarded polyurethanes of this invention are: lactone-based polyols prepared by reacting a lactone such as epsilon-caprolactone or a mixture of epsilon-caprolactone and an alkylene oxide with a polyfunctional initiator such as polyhydric alcohol, an amine, or an aminoalcohol; and phosphorus-containing polyols such as the alkylene oxide adducts of phosphoric acid, polyphosphoric acids such as tri- and tetra-phosphoric acids, organo-substituted phosphoric acids such as benzene-phosphoric acid and the like.

It is preferred in accordance with the present invention that the polyurethane products have a molecular weight of at least 15,000 in order to provide foam product of sufficiently high strength. To achieve this molecular weight it is important that the condensation reaction be carried out with a carefully determined ratio of NCO groups to —OH or other active hydrogen groups in the reaction mixtures of the "one-shot" process so that there is preferably an excess of —NCO groups to reactive hydrogen (referred to hereinafter for convenience as the NCO/OH ratio). A preferred NCO/OH ratio is by weight from in excess of 1 to 1.15 parts of NCO groups to 1 part of reactive hydrogen (expressed as OH component). An NCO/OH ratio of 0.95 to 1.15:1 is however practicable.

The production of the cellular products of the invention involves further the employment of a suitable foaming or blowing agent. Carbon dioxide from water added to the reaction system is the most desirable agent for the purpose of securing cellular formation and expansion. The water will also serve as an added source of active hydrogen in the reaction system. Conventional halocarbons, such as the haloalkanes, e.g. monofluorotrichloromethane, may also be so utilized to lower density but are normally omitted in that their presence invites a proportional diminution in load bearing capacity.

Conventional silicone surfactants are desirably, but not necessarily, incorporated in the reaction system of the invention in order to stabilize, in conjunction with the catalysts present, the cellular foam product. The surfactant may be added with any of the two to six streams usually fed to the mixing head in the one-shot process immediately upstream of the foam reactant entry port 34 of the first tube 30.

The amount of silicone surfactant utilized is on a weight basis of normally about 0.8 to 1.5 part, and preferably about 1.0 part, silicone to each 100 parts of polyol.

The catalysts employed in preparing these high resilience foams are well-known and are usually tertiary amines or combinations thereof. These amines, while water-isocyanate catalysts (and thus primarily responsible for foam production), also have a substantial and efficacious effect on polymer formation, which however varies with the particular amine employed. Most effective in polymer formation of these amines is 1,4-diazabicyclo [2.2.2] octane. Additional amine catalysts which may be used alone or preferably in combination with each other and most desirably with the foregoing diazabicycloctane are illustratively, dimethyl ethanolamine, N-ethylmorpholine, cyclohexylamine, and dimethylaminoethyl ether.

The use of conventional metallorganic catalysts such as stannous octoate, which tend to promote the reaction between the polyol hydroxyl moieties and the diisocyanates, is not essential to the formation of the desired foams although they may be used if desired in combination with one or more of the foregoing amines.

Optional additives conventionally employed in the production of these flexible foams include cell stabilizers, flame retardants, such as antimony oxide.

Other additives such as dyes, pigments, soaps and inert fillers and the like can also be added to the foam mixture to obtain special foam properties in accordance with practices well known in the art.

Methods of producing one-shot flexible polyether and polyester urethane foams commercially include numerous processing variables well known to those skilled in the art. The process will, for example, go forward desirably in the mixing head, at slightly elevated temperatures, for example, 70° F. to 120° F. The cream time, that is the period of time required for the generated carbon dioxide to saturate the reaction mixture is normally in the range of 10 to 20 seconds.

In applying the standard and preferred one-shot process to the process of this invention, the mixing head (not shown) is mounted in the port 34 and, optionally, the second port 40, or such additional foam entry ports as may be provided, and each component is admitted to the mixing head and thence through the port 34 (and 40) into the tube 30 (and the tube 31 where the second part 40 is employed).

The resin components enter the mixing head through individual feed lines at a predetermined ambient temperature. The silicone component, where employed can, however, be added to any of the streams, usually two to six in number. Often, too, the number of feed lines entering the head is reduced by introduction of the catalyst or other components, used only in small amounts, into the polyol lines upstream from the mixing head. An inline blender can be used optionally to premix the components of the reaction system before they reach the mixing head. Regular calibration of the component streams is of considerable assistance in determining metering efficiency. Orifice opening control, back pressure in the metering head, processing procedures, and related steps are also adjusted within well known, flexible and discretionary limits.

The prepolymer process can also be employed conveniently. In this latter process the polyisocyanate mixture is reacted in a preliminary step with a portion of the polyol, normally up to 0.5 equivalent of polyol per equivalent of isocyanate, and the isocyanate-terminated prepolymer is used in the reaction with the remainder of the foam components using the techniques described hereinabove with respect to the one-shot method.

As indicated elsewhere herein the composite fiber products are obviously capable of a wide variety of after-treatment for various purposes. Thus, by way of illustration, polyurethane foam coating of polypropylene fibers can be far more inexpensively, easily, and intensely colored by post-dyeing of the composite fibers of the invention than the polypropylene fibers themselves, while retaining the advantages of the latter as core fibers. In composite foam-fiber production, post-dyeing and dyeing conditions are available for treatment of the sheath including one-bath dye technique that would not be applicable to a particular underlying core fiber.

It is noted, too, that it is not essential that the composite fibers have an essentially cylindrical shape in cross-section. The product fibers can be given any of a variety of conformations such, for example, as the essentially dumb-bell cross-section of Orlon and are conveniently available using conventional techniques well-established in the relevant art.

In addition, the core fibers can be pre-made conveniently into any of a variety of cross-sectional conformations, before application of the sheath 19, for example, bifurcate or dumb-bell, or ovoid; or individual fibers or filaments produced as a twisted or helical yarn; and by appropriate choice of tubing cross-section, the foam sheath can be formed into any desired cross-sectional configuration about the core fiber 12. Thus, an ovoid sheath 19 may disposed about a circular, dumb-bell or helical fiber. Proper use of embossing rolls, for example, can give the finished composite fiber the scaly outer surface so characteristic of wool.

The foam of the outer ply or skin 16 can also be buffed into a suede-like finish when production of the composite fiber is otherwise completed. In the event such post-treatment is contemplated it is desirable to provide an outer ply 16 of greater thickness than might otherwise be necessary or desirable and even exceeding the maximum range recited hereinabove. The sheath will normally be within the maximum range recited when surface treatment such as the foregoing is terminated.

The following examples are further illustrative of the invention. In these examples all parts and percentages are by weight unless otherwise expressly indicated.

EXAMPLE 1

This example illustrates the preparation of a composite fiber according to the invention.

A glass fiber having an L/D ratio in excess of 20,000 is dispensed from a reel and advanced through apparatus similar to that of FIG. 2 but employing a single rigid tube, made entirely of TEFLON. The fiber is centrally positioned in the tube and pulled through it by a pick-up reel mounted at the opposite end of the tube. The tube is a cylinder having a uniform diameter of $\frac{1}{4}$ inch. The inner wall of the tube is smooth and regular.

The glass fiber employed has a diameter of slightly less than $\frac{1}{8}$ inch. Immediately downstream from the point of entry of the fiber into the tube, a foamable polyurethane resin is prepared by high speed mixing employing the one-shot process and is passed into the reaction tube and about the core fiber. The travelling fiber carries the foam with it as the foam creams, rises and cures enough to be self-supporting in about the first five minutes of tube travel. The rate of passage through the tube is approximately about 1 foot per minute. At this stage, the foam has about the same thickness as the fiber, even though the foam weighs, per unit length, less than 10 percent of what the fiber weighs.

The flexible, open-cell polyurethane foam employed is prepared by high speed mixing of the following components in the amounts indicated and in which the reference to parts is to parts per one hundred parts by weight of polyol:

34.9 parts of a mixture of 30 percent by weight of toluene diisocyanate (65/35) and 70 percent by weight of polymethylene polyphenyl isocyanate [eq. wt.=135; contains approximately 50 percent methylenebis (phenyl isocyanate)].

100 parts of a mixture of:

69.2 parts poly(oxyethylene oxypropylene) triol, containing 50 percent primary OH (SF-6500; eq. wt.=2200).

7.4 parts of the adduct of 1 mole of trimethylolpropane and 3 moles of ethylene oxide (eq. wt.=93).

2.0 parts of chlorinated aromatic diamine (liquid blend of methylenebis(o-chloroaniline)[LD 813].

7.2 parts of antimony trioxide, 10.6 parts of polyvinyl chloride (QYKV), 3.6 parts of hexabromobenzene.

(The latter three components were employed in the form of powders which were dispersed by high speed stirring in a blend of the other components.)

1.75 parts of water;

0.7 parts of triethylenediamine (33 percent solution in dipropylene glycol);

0.1 parts of stannous octoate.

The second half of the tube is heated to an effective temperature of about 140° C., forcing the foam to rise further against the undistortable inner tube surface, causing compression of the outer perimeter of the foam to effect a density in excess of 30 pcf, therein; a concomitant decrease in the cell size of the foam of this outer zone; and imposing a smooth, gas permeable surface thereon, the latter as a result of the combination of heat treatment and simultaneous passage through the tube. The composite fiber product, pulled through the tube by the pick-up reel about which the product fiber is wound, is composed of a glass core fiber about $\frac{1}{8}$ inch in diameter, having an outer coating of a uniform thickness of slightly in excess of $\frac{1}{8}$ inch compressed at its outer periphery as described hereinabove and having an open macrocellular construction with a density of less than 30 pcf. The compressed outer zone has a thickness of about 80 mils. The foam sheath adheres firmly to the glass core fiber. The composite fiber manifests a warm pleasant hand, can be handled without fear of glass slivers, can be dyed whereas the glass core fiber alone can only be melt-pigmented before it is drawn, and provides a resistance to impact that the glass does not have. It is also more readily processible than the glass fiber alone; being, for example, receptive readily to crimping, embossing and the like and thus having a much greater scope of utility than that available for glass fibers commonly used only in draperies. The composite fiber of the Example is at the same time receptive to spinning, weaving, bonding, floccing and can be utilized in preparing improved textile fabrics for use in clothing and the like.

EXAMPLE 2

This example illustrates the preparation of a composite fiber according to the invention but employing a different core fiber than that recited in Example 1.

The process of Example 1 is repeated, substituting an asbestos fiber of $\frac{1}{8}$ inch diameter for that of the glass fiber of Example 1. The same foam formulation is prepared by the one-shot process and applied to the asbestos core fiber in the manner recited in Example 1 except that 70 parts by weight per 100 parts by weight of polyol of aluminum hydroxide are introduced into the resin as an ignition resistor. The product composite fiber is a warm, resilient strand that can be woven readily into industrial mats and that can be handled without fear of toxic dust. The additional flame retardant permits the composite fiber to resist heat and fire without significant impairment as contrasted to the asbestos fiber alone.

EXAMPLE 3

This example illustrates the preparation of composite fibers according to the invention using the prepolymer process for preparing the polyurethane foam employed and a plurality of different fibers from those of the prior examples.

A flexible flame retardant polyurethane foam of the invention is prepared using the ingredients and proportions set forth in Example 1 but replacing the polyisocyanate mixture there used by the following:

62.9 parts of a prepolymer obtained by reacting 50 parts poly(oxyethylene oxypropylene)triol [SF-6500] and 100 parts of a mixture containing 70 parts of toluene diisocyanate (65/35) and 30 parts of polymethylene polyphenyl polyisocyanate [eq. wt. 133; contains approximately 50 percent of methylenebis(phenyl isocyanate)].

The foregoing foam is introduced into the tube and about the core fiber in each instance in the manner described in Example 1. Experimental lengths of core fiber having an L/D ratio in excess of 20,000 are used in each instance. The core fibers treated and incorporated into composite fibers as described in Example 1 are Nylon-6, cotton, polyester, and polypropylene.

Each of the core fibers is about 1/16 inch in diameter and the foam sheath is slightly in excess of 1/5 inch in diameter in each composite fiber product. All of the composite fibers produced evidence of the advantages of improved hand, high bulk, and low weight warmth, resilience, breathability, processibility, and capability of being spun, woven, flocced, crimped and the like. When woven, the core fibers alone, evidence far more interstitial space, less resilience and less ability to resist both impact and flow of heat than the composite fibers of the invention. In addition, the core fibers alone, being more dense than the composite fibers, require greater weight without providing equal bulk and so are less economical to convert into fabrics for use in clothing.

EXAMPLE 4

(a) A preparative train is created consisting of a horizontal, stiff TEFLON tube, about 6 inches long and $\frac{1}{2}$ inch inner diameter, and on the same level and about 10 ft. downstream, a similar TEFLON tube, $\frac{3}{8}$ of an inch in diameter and 6 ft. long, then a source of heat such as an infra-red bank, and finally a wind-up reel. The first tube is fitted, at its upstream and downstream ends with means for maintaining the forward-moving core fiber or thread of $\frac{1}{4}$ inch diameter concentrically within the tube. Just downstream of the upstream end of the first tube, coming into the bottom of the tube, is a $\frac{1}{2}$ inch port, and a similar one is placed on top of the tubular mold just upstream of the other end of the tube. The upstream bottom port serves to introduce the foam-making ingredients and the downstream, topside port serves to carry away, as overflow, the unused ingredients. The second, longer, tube is aligned with the first, and serves to compress and create a skin on the foam. If necessary, heat can also be applied between the two tubes and after the second one. The lumen of the second tube contracts gradually and uniformly toward its downstream fiber exit port.

Nylon-66 cord of $\frac{1}{4}$ inch diameter is threaded from its feeding spool through the first tube, through the foregoing intervening space when the fiber is exposed to the ambient atmosphere, through the second tube and an additional space of about 4 feet to a take-up roll. The rate of passage of the cord is about one foot per minute, so the cord is in the first tube for about half a minute and in the longer tube for about six minutes. Simultaneously, there is freshly, vigorously and continuously mixed outside the tube a formulation comprising 100 parts of poly-(diethylene glycol adipate)polyol of 2.3 hydroxyl functionality and about 2500 molecular weight; an ethylene oxide-dimethylsiloxane copolymer commercially available from Union Carbide as L 532 Surfactant, a commercially available triethylenediamine solution equivalent to about 0.6 parts; an 80:20 mixture of 2,4- and 2,6-toluenediisocyanate, 48.5 parts, water, 2.25 parts; and stannous octoate, 0.2 parts, as a 1:4 solution in tricresyl phosphate. As quickly as the streams are mixed they are pumped into the upper end of the tube at such a rate that the tube is kept filled with reactants that have just barely started to cream before they are forced out of the tube. By adjusting the size of the aperture or exit port in the end of the first tube, the pick-up of the foam-forming ingredients by the nylon can be controlled for any given rates of foam and nylon feed. The pick-up of resin weight is 22% of the weight of the cord, on an average. In the fast-rising formulation of ester-based polyurethane used, it is desirable to bring the second tube about 4 ft. closer to the first tube, so that the rising foam-fiber combination travels about 6 feet unconfined between. To prevent peeling of the fresh foam from the nylon as it enters the second tube, the upstream end of that tube flares outward, to make the compression step somewhat gentler. The tube is kept at approximately 130° C. by external heating, which, with the approximately 6 minutes compression time, is enough to form a light (i.e. thin) continuous but not impermeable skin about the outer circumference of the foam. A thicker skin is obtainable by stronger compression of the foam, either by use of a hotter, longer smaller-diameter second tube, or by generating more gas from the isocyanate-water reaction within the second tube, i.e. bringing the second tube up to where the foam on the fiber completes its rise within the early part of travel in the second tube. When incompletely cured but compressed and skin foam is wound up, the product tends to stick to itself and to set in a permanent curl. Both undesirable qualities are prevented by not using the wind-up reel until the product is at least 8 hours old. The product as made and aged without wind-up is a flat-lying length of nylon cord completely and adherently enclosed in a concentric cover of uniformly open foam having a darker, denser, but microcellular smooth skin. Thickness of the foam layer is slightly greater than $\frac{1}{8}$ inch, so that a 22% by weight foam pick-up has given a 100% increase in diameter. This degree of bulking is not obtainable by the mechanical bulking of a yarn as stretchable or extensible as that.

(b) When the process is repeated using an ether-based polyurethane foam-forming composition comprising a poly-(oxypropylene)triol of about 3500 molecular weight, 100 parts by weight, 46 parts of the same toluene diisocyanate isomer mixture, 1 part of a siloxane-ethylene oxide-propylene oxide terpolymer available as L 550, 3.5 parts of water, 0.3 parts of stannous octoate and 0.3 parts of the triethylenediamine catalyst, the following differences from those secured with the composite fiber of Example 4 (a) are noted:

(a) The foam is slower to cream and rise, so the dwell time before the second tube has to be increased by a factor of about 0.6 to 1.4.

(b) The foam is more resistant to compression and skin formation. A satisfactory skin is formed, and the foam suitably compressed, when the amount of water in the urethane formulation is increased to 3.6 parts, the isocyanate mixture to 48 parts, and the amine catalyst replaced by one containing a small amount of acid, and the second tube moved downstream about nine feet from the first.

The products of this Example cannot be separated into foam and nylon cleanly; in both cases, all attempts to peel the foam away gives tearing within the foam, rather than at the interface. The torn foam has densities of about 18 lbs. per cubic foot for the ester, and about 9 lbs. for the ether. Primarily because of the difference in densities, the ether foam products shows a better hand and drape than does the ester foam. At equal densities of foam, especially at densities of about 7 lbs. per cubic foot and less, which are attainable when gases like $CO_2$, $CFCl_3$, or $CH_2Cl_2$ are co-used with the foam formulation, the polyester foam gives the better hand and drape. Regardless of density, both foams impart a warmer and more inviting feel to the touch than does the nylon cord alone. Regardless of the foam used, the foam-nylon composite provides better insulating properties than the nylon alone. Thus, when tightly hand-woven mats of the Nylon 66 and nylon-foam composites are made by simple braiding, then placed between a beaker of boiling water and a thermocouple, the thermocouple under the relatively porous mat of nylon alone rises to its maximum temperature in less than a minute, whereas the mats of foam-nylon, with less apparent interstitial air space, require at least 35% more time for the thermocouple to reach its maximum reading.

EXAMPLE 5

The process of Example I above is repeated using a carbon-dioxide-containing tolylene-isocyanate mixture and preparative conditions that yield repeatedly, as the final product, Nylon cord coated with a polyurethane coating of about the same thickness total i.e. a $\frac{1}{8}$ inch thick layer around the $\frac{1}{4}$ inch diameter core fiber, and a foam density of about 3.2 lbs. per cubic foot.

The product is processed without tubular confines and results in a skin-free product having an uncompressed sheath of highly irregular cross-sectional configuration. The product is also somewhat coarser-celled and of about 1.1 lbs. per cubic foot density. This product lacks abrasion resistance, so all attempts to braid it into a mat give not only a very porous weave, but also a noticeable amount of unacceptable dusting of the foam.

EXAMPLE 6

A continuous strand of asbestos fiber of about 2.5 specific gravity is pulled through a glass tube approximately 30 ft. long and having an inner diameter of ¼ inch. Approximately 6 inches downstream from the introduction of the fiber, a port in the tube below and at right angles to the tube introduces an unpulsating stream of just-mixed Fomrez 50 (Witco's diethylene glycoladipic acid polyester diol and triol), an 80:20 toluenediisocyanate isomer mixture, in a 65 polyol:35 isocyanate ratio by weight, the polyol containing the necessary water, catalysts, and surfactants. The weight of foam-forming reactants delivered per unit time to the asbestos is approximately 25% of the weight of the fiber passing in that time, which, under those conditions, is the minimum foam:fiber weight ratio manageable. When the fiber-foam combination is pulled downstream at 1–5 feet per minute, a thorough coating of the fiber occurs as the foam reactants go through their cream and rise stages. Heat is applied about 2 minutes downstream of the foam introduction (i.e. at 5 ft. per minute linear travel, about 10 ft. down), sufficient to generate over 135° C. in the tube, and maintained the rest of the reactor or tubular mold length. Experience shows that use of a release agent and of a nitrogen atmosphere are desirable. By proper adjustment of the rates of delivery of the foam and fiber, their travel and the time and temperature of compressive cure, there can be obtained useful lengths of asbestos fiber adherently and concentrically coated with a supple resilient coating of polyurethane foam the thickness of which, by choice of tube diameter and other variables, can be varied from about 12–750 mils thick, but always (given good operation) with a thin, tough microcellular skin.

The product has a far more pleasant hand than the starting asbestos, and is far less dangerous in its tendency to dust. It is believed to be useful for aerospace and related applications, since it can be carbonized, it it understood, under ablative conditions, to bi-component fibers of carbon and asbestos.

EXAMPLE 7

A length of clean, undyed wool yarn is passed through a plastisol compositon containing, for each 100 parts of polyvinyl chloride resin, 50 parts of dioctyl phthalate, 5 parts of mineral spirits, 2 parts of barium-cadmium stearate, and 2 parts of azobisformamide, then forced through a tight die that leaves about 40% of the wool's weight of plastisol still on the wool. The wet wool passes through a long, heated glass tube, in a flowing stream of nitrogen, to foam and gel the thermoplastic resin, and then through a longer, hotter tube of the same inner diameter as the die, to form the skin. Unless the wool is first degreased and dried, the foam, which comprises about half the composite thickness, does not adhere well to the fibers. The final product is uniformly pleasing to the touch, is as consistently dyed and dyeable and readily woven, resists abrasion better, and is not consumed by moths in storage, as wool. The product fiber is also less hygroscopic in humid atmospheres, and its physical properties are resistant to the deleterious effects of any absorbed moisture.

EXAMPLE 8

A commercially available spool of polyester thread is passed through a long capillary while simultaneously freshly mechanically frothed rubber latex is forced through it, the whole assembly being heated to dry the foam. The formulation of latex is a commercial one for foam-rubber, i.e. self-gelling. The foam-enclosed thread is pulled through a hot metal capillary to compress the composite fiber from about a 2 mm diameter down to about a 0.7 mm diameter for a sufficient length of time to form skin and a composite diameter of about 1.1 mm on being released. The product, handwoven into a small mat, makes a better insulator against impact and heat than does the starting thread.

EXAMPLE 9

A commercially available skein of rayon yarn is continuously passed through a special prepolymer for making hydrophilic flexible polyurethane sold under the trade name HYPOL by W. R. Grace & Co., Lexington, Mass. then immediately subjected, away from the container of HYPOL, to the stream from a boiling 1 percent aqueous ammonium hydroxide solution for a period of at least 4 minutes. During the last two of those minutes, and for an additional two minutes travel thereafter, the coated yarn is compressed by passage through a heated metal tube, Silicone coated, inside, having an inner diameter only about 10% greater than the that of the starting skein. The final product is a skin-bearing, flexible and resilient foam fiber that is readily swelled by large changes in humidity. When properly made and treated, it is especially useful as a source of surgical and catamenial pads.

EXAMPLE 10

A small pultrusion is established by which at least three parallel contiguous glass fibers are pre-wet with 3-amino-propyltriethoxysilane bonding agent, heat-treated, then immersed in a commercially available RTV (room temperature vulcanizing) silicone foam rubber forming formulation, clustered tightly, and cured under heat and pressure. The 2-component RTV composition is mixed and forced onto the fibers within a minute of first mixing; the ratio of glass fibers to silicone-formers is about 12:1 by weight. The tightly clustered composite can travel downstream unconfined for up to 3 minutes, but better results are obtained if, immediately downstream of the application, the reacting mixture and its substrate are retained under autogeneous pressure at 60°–90° C. for 4 to 10 minutes. Under those conditions, the product is a very strong composite fiber of resilient, flexible foam, chemically inert, enclosing three parallel contiguous glass fibers and essentially cylindrical in cross-section. The product is useful in industrial applications requiring resilience, thermal and chemical stability and strength, e.g. in aerospace applications. It becomes more useful for ablative space applications when less than half the weight of glass fiber is replaced by an asbestos-type fiber. The product becomes useful for homes and offices, e.g. in draperies, when the RTV composition is replaced by a flexible polyurethane foam-forming composition.

EXAMPLE 11

Composite fibers produced in accordance with the procedure of Example 4 incorporating a variety of core fibers of ¼ inch thickness; the properties thereof alone and as a component, in each instance of the foregoing indicated composite fibers, are recited in Table I appearing hereinafter;

Table I

| Core Fiber | Nylon-6 | Cotton cord | DACRON* poly-ester cord | Polyethylene cord |
|---|---|---|---|---|
| Composite | | | | |

Table I-continued

| Core Fiber | Nylon-6 | Cotton cord | DACRON* poly-ester cord | Polyethylene cord |
|---|---|---|---|---|
| thickness, inches | 9/16 | 7/16 | 8/16 | 9/16 |
| Foam appearance | good | good | good | good |
| Skin appearance | good | thin | good | thick |
| Foam adhesion | good | best | good | spotty |
| Hand improvement over core fiber | good | good | good | best |
| Methylene Blue dyeability; composite fiber: | good | good | good | good |
| core fiber: | good | tint | tint | none |
| Breaking Strength; core fiber: | 1200 | 380 | 1100 | 800 |
| composite fiber: | 1400 | 510 | 1200 | 800 |
| Wet Strength; core fiber: | 980 | 310 | 1050 | 820 |
| composite fiber: | 1410 | 460 | 1200 | 820 |
| Woven mat appearance; core fiber: | open | less | open | open |
| composite fiber: | tight | tight | tight | tight |
| Mat feel core fiber | dead | dead | dead | dead |
| composite fiber | All about equally resilient, lively | | | |
| Time to thermocouple peak core fiber | 53 secs | 62 secs | 56 secs | melts fiber |
| composite fiber | 62 secs | 64 secs | 63 secs | no melting |

*Polyethylene glycol diterephthalate; product of E.I. du Pont de Nemours, Wilmington, Delaware The unexpected superiority of the composite fibers of the invention will be evident from the foregoing Table. Each of the recited core fibers and composite fibers are useful for textile application.

The present invention thus provides, inter alia, a composite fiber having a continuous, regular skin and is particularly suitable for knitting, weaving, floccing and the like, having in addition, a full, resilient hand, breathability, processability and a continuous, regular surface, and which will resist the adsorption of dirt and particulate matter, and is at the same time susceptible to dry cleaning.

It will be evident that the terms and expressions which have been employed are used as terms of description and not of limitation. There is no intention in the use of such terms and expressions of excluding equivalents of the features shown and described or portions thereof and it is recognized that various modifications, by way of illustration, but not of limitation, variations in proportions, procedure and materials are possible within the scope of the invention claimed.

What is claimed is:

1. A composite fiber suitable for spinning, weaving or floccing comprising a core fiber and adhering thereto a sheath of a resin foam having a smooth continuous regular outer surface; and sheath comprising an inner zone adhering to said core fiber and an outer zone of increased density and smaller cell-size; the outer surface of which is gas permeable, smooth and regular.

2. A composite fiber as claimed in claim 1 wherein said inner zone is macrocellular in construction.

3. A composite fiber as claimed in claim 1 wherein said outer zone is microcellular.

4. A composite fiber as claimed in claim 1 wherein said core fiber is a flexible thermoplastic polymer.

5. A composite fiber as claimed in claim 1 wherein said core fiber is a flexible glass fiber.

6. A composite fiber as claimed in claim 1 wherein said sheath is flexible polyurethane.

7. A composite fiber as claimed in claim 1 wherein both said inner zone and said outer zone comprise a flexible cellular thermosetting foam selected from a polyester urethane and a polyether urethane.

8. A composite fiber as claimed in claim 7 wherein said foam of said inner zone is resilient uncured and thermosettable and has a density of less than 30 pounds per cubic foot.

9. A composite fiber as claimed in claim 7 wherein said foam of said outer zone has a density of at least 30 pounds per cubic foot.

10. A composite fiber as claimed in claim 9 wherein the outer surface of said outer zone is smooth, regular, microporous and thermoset.

11. A composite fiber as claimed in claim 9 wherein said foam of said outer zone has a density of up to 80 pounds per cubic foot.

12. A composite fiber as claimed in claim 9 wherein said foam of said outer zone has a density of from 50 pounds per cubic foot to 70 pounds per cubic foot.

13. A composite fiber as claimed in claim 1 wherein said core fiber has a length to diameter ratio of at least 20,000.

14. A composite fiber as claimed in claim 1 wherein the thickness of said inner zone is from 10 percent to 500 percent that of the radius of said core fiber.

15. A composite fiber as claimed in claim 1 wherein the thickness of said outer zone is from about 0.01 percent to 100 percent that of said core fiber.

16. A composite fiber as claimed in claim 1 wherein the weight of said sheath is in excess of one half that of said core fiber.

17. A composite fiber as claimed in claim 16 wherein said sheath is composed of polychloroprene and said core fiber comprises polypropylene.

18. A composite fiber as claimed in claim 17 wherein said polychloroprene has a density of from 22 pounds per cubic foot.

19. A composite fiber as claimed in claim 1 wherein said sheath weighs from 1 percent to 50 percent of the weight of said core fiber.

20. A composite fiber as claimed in claim 1 wherein said sheath has a thickness of up to three times that of said core fiber.

21. A composite fiber as claimed in claim 1 wherein said outer zone has a cross-sectional area 10 percent to 15 percent that of the cross-sectional area of said sheath.

22. A composite fiber as claimed in claim 1 wherein the thickness of said sheath is from 0.5 mil to 0.25 inch and the thickness of said core fiber is from 0.5 mil to 0.25 inch.

23. A composite fiber as claimed in claim 22 wherein the thickness of the outer zone of said sheath is from 0.5 mil to 5 mils.

24. A composite fiber as claimed in claim 1 wherein the density of said inner zone is from 1.5 pounds per cubic foot to 30 pounds per cubic foot.

25. A composite fiber as claimed in claim 1 wherein said resin foam of said sheath is an open or partially open cellular, flexible, resilient and extensible foam.

26. A composite fiber as claimed in claim 1, wherein said core fiber is a flexible glass fiber and said sheath is composed of silicone rubber foam.

27. A composite fiber as claimed in claim 1 wherein said core fiber is a flexible glass fiber and the foam of said sheath is a polyester urethane.

28. A composite fiber as claimed in claim 1 wherein said core fiber is a flexible glass fiber and the foam of said sheath is a polyether urethane.

29. A composite fiber as claimed in claim 27 or claim 28 wherein said foam is a flexible foam.

30. A composite fiber as claimed in claim 27 or claim 28 wherein said foam is a semi-flexible foam.

31. A composite fiber as claimed in claim 1, wherein said core fiber is a glass fiber and said sheath is composed of a flexible thermosetting polyurethane foam.

32. A composite fiber as claimed in claim 1 wherein said core fiber is composed of a polyamide.

33. A composite fiber as claimed in claim 1 wherein said core fiber is composed of a polyester.

34. A composite fiber as claimed in claim 1 wherein said core fiber is composed of a polyamide and said sheath is composed of a flexible thermosetting polyurethane foam.

35. A composite fiber as claimed in claim 1 wherein said core fiber is composed of a polyolefin.

36. A composite fiber as claimed in claim 1 wherein said core fiber is composed of a polycarbonate.

37. A composite fiber as claimed in claim 1 wherein said core fiber is composed of asbestos.

38. A composite fiber as claimed in claim 1 wherein said core fiber is composed of a flexible, extensible, synthetic organic, thermoplastic resin.

39. A composite fiber as claimed in claim 37 wherein the sheath surrounding said core fiber is a polyurethane foam.

* * * * *

UNITED STATES PATENT AND TRADEMARK OFFICE

CERTIFICATE OF CORRECTION

PATENT NO. : 4,265,972

DATED : May 5, 1981

INVENTOR(S) : Bernard Rudner

It is certified that error appears in the above-identified patent and that said Letters Patent is hereby corrected as shown below:

Column 4, line 62, cancel "polyhalaloalkanes" and substitute -- polyhaloalkanes --.

Column 6, line 61, cancel "10" and substitute -- 12 --.

Column 8, line 44, cancel "fron" and substitute -- from --.

Column 9, line 7, cancel "is".

Column 19, line 35, cancel "it it" and substitute -- it is --.

Column 21, line 65, claim 1, line 4, cancel "and" and substitute -- said --.

Signed and Sealed this

*Twenty-first* Day of *September 1982*

[SEAL]

*Attest:*

GERALD J. MOSSINGHOFF

*Attesting Officer*

*Commissioner of Patents and Trademarks*